United States Patent [19]

Porter

[11] Patent Number: 4,852,357

[45] Date of Patent: Aug. 1, 1989

[54] CRYOGENIC LIQUID PUMP

[75] Inventor: Warren W. Porter, Escondido, Calif.

[73] Assignee: NCR Corporation, Dayton, Ohio

[21] Appl. No.: 258,261

[22] Filed: Oct. 14, 1988

[51] Int. Cl.[4] ..... F17C 9/04

[52] U.S. Cl. ..... 62/50.4; 62/50.6; 62/50.7

[58] Field of Search ..... 417/118, 137, 901; 62/49, 50, 55

[56] References Cited

U.S. PATENT DOCUMENTS

| | | | |
|---|---|---|---|
| 1,606,356 | 11/1926 | Fisher | 137/398 |
| 1,745,762 | 2/1930 | Holmes | 137/416 |
| 1,951,758 | 3/1934 | Jones | 62/50 |
| 2,454,934 | 11/1948 | Mathis et al. | 62/50 |
| 2,530,382 | 11/1950 | Downs | 417/137 |
| 2,999,509 | 9/1961 | Hankinson et al. | 137/195 |
| 3,049,887 | 8/1962 | Sharp et al. | 62/55 |
| 3,202,174 | 8/1965 | Rudelick | 137/432 |
| 3,233,625 | 2/1966 | Pase | 137/416 |
| 3,234,746 | 2/1966 | Cope | 417/901 |
| 3,260,061 | 7/1966 | Hampton et al. | 62/55 |
| 3,397,870 | 8/1968 | McCann et al. | 261/19 |
| 3,399,691 | 9/1968 | Schoch et al. | 62/55 |
| 3,440,829 | 4/1969 | Davies-White | 62/51 |
| 3,729,946 | 5/1973 | Massey | 62/55 |
| 3,941,509 | 3/1976 | Gillilian et al. | 417/118 |
| 4,360,038 | 11/1982 | Trinkwalder | 137/390 |
| 4,489,569 | 12/1984 | Sitte | 62/514 R |
| 4,506,512 | 3/1985 | Delacour et al. | 62/49 |

*Primary Examiner*—Ronald C. Capossela

*Attorney, Agent, or Firm*—Wilbert Hawk, Jr.; Stephen F. Jewett; Douglas S. Foote

[57] ABSTRACT

A pump and method for delivering a cooling fluid from a reservoir of fluid to a destination is disclosed. The pump comprises a vessel for holding fluid to be delivered, the vessel being submersible within the reservoir. The vessel has a fluid inlet near its bottom for receiving fluid from the reservoir and a gas discharge outlet near its top. The pump has an inlet valve for preventing fluid from flowing out of the vessel through the fluid inlet, and a gas discharge valve for opening and closing the gas discharge outlet. The discharge valve is responsive to the level of fluid within the vessel. The pump also comprises a conduit for conducting fluid from inside the vessel to its destination, and heating means for evaporating the fluid within the vessel. This heating creates a pressure head within the vessel when the gas discharge outlet is closed thereby causing the fluid to flow through the conduit.

17 Claims, 4 Drawing Sheets

CRYOGENIC LIQUID PUMP

The present invention relates to fluid pumps, and, more particularly, to pumps for delivering relatively small quantities of cooling fluid at low pressures.

BACKGROUND OF THE INVENTION

The performance of some electronic devices can be improved by cooling them to cryogenic temperatures. Such cooling can be achieved by the use of a cryogenic fluid such as liquid or gaseous Nitrogen or Helium. For many cooling configurations an electronic device is brought into thermal contact with fluid held in a relatively small container. As the device is cooled, fluid is evaporated which must then be replenished from a remotely located reservoir. The fluid pressure in the container is generally low, typically atmospheric, whereas the pressure in the reservoir may be the same or higher. Conventional pumps are unable to efficiently provide the automatic, low volume, low pressure and low temperature operation required by such applications.

OBJECTS OF THE INVENTION

It is therefore an object of the present invention to provide a new and improved pump and method for automatically delivering a cryogenic fluid from a reservoir to a remote destination.

It is another object of the present invention to provide a pump and method for delivering low or high pressure cooling fluid to a destination having a predetermined pressure.

It is a further object of the present invention to provide a pump and method capable of delivering a relatively low volume of cooling fluid from a reservoir to a destination.

SUMMARY OF THE INVENTION

The present invention is a pump and method for delivering a cooling fluid from a reservoir of fluid to a destination. The pump comprises a vessel for holding fluid to be delivered, the vessel being submersible within the reservoir. The vessel has a fluid inlet near its bottom for receiving fluid from the reservoir and a gas discharge outlet near its top. The pump has an inlet valve for preventing fluid from flowing out of the vessel through the fluid inlet, and a gas discharge valve for opening and closing the gas discharge outlet. The discharge valve is responsive to the level of fluid within the vessel. The pump also comprises a conduit for conducting fluid from inside the vessel to its destination, and heating means for evaporating the fluid within the vessel. This evaporation creates a pressure head within the vessel when the gas discharge outlet is closed thereby causing the fluid to flow through the conduit.

The method comprises immersing a pump in the reservoir, admitting fluid from the reservoir into the pump, evaporating cooling fluid within the pump to create a gas pressure head in the pump, and delivering fluid from the pump to the container in response to the pressure head.

DETAIL DESCRIPTION OF THE INVENTION

Figure 1:
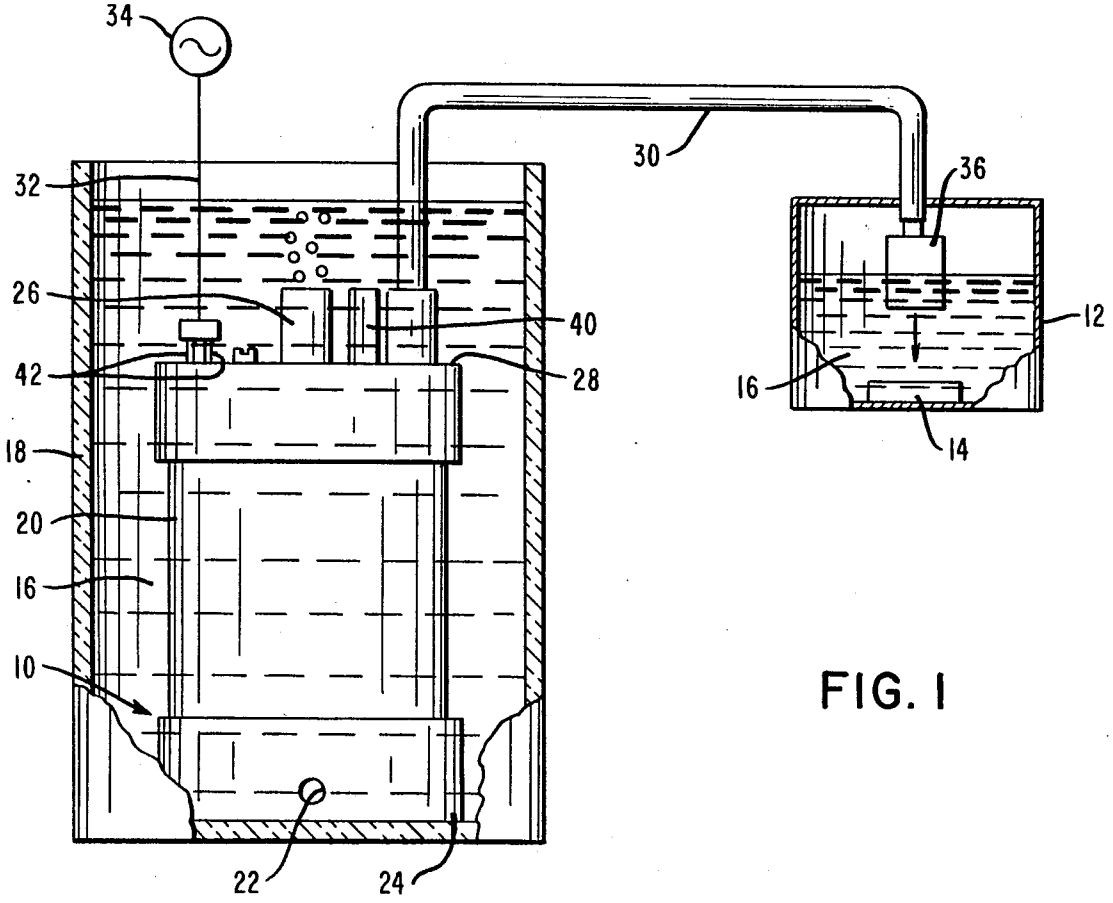
FIG. 1 is a partial cross sectional schematic side view of an operating pump submerged in a reservoir according to one form of the present invention.

FIG. 1 shows a system utilizing a pump 10 according to one form of the present invention. A container 12 houses an electronic device 14 immersed in a cooling fluid 16 which is preferably a cryogenic fluid such as liquid Nitrogen or Helium. Cooling fluid is delivered by pump 10 to container 12 from a reservoir 18 containing fluid 16.

Pump 10 comprises a vessel 20 for holding cooling fluid to be delivered to container 12. As shown, vessel 20 is submerged in the fluid 16 within reservoir 18. Cooling fluid is received by vessel 20 through a fluid inlet 22 near the bottom 24 of vessel 20. The gas of evaporated fluid is released (under certain operating conditions to be discussed more fully hereinafter) by vessel 20 through a gas discharge outlet 26 near top 28 of vessel 20. A conduit 30 conducts cooling fluid from inside vessel 20 to container 12 by means to be discussed more fully hereinafter. Container 12 also includes a mechanical liquid level controller 36 which senses the level of fluid within container 12 and restricts the flow of cooling fluid through conduit 30 when the fluid within container 12 rises to a predetermined level. In a preferred embodiment, controller 36 is a conventional float valve. Also shown extending through top 28 of vessel 20 is the outlet end 40 of a pressure relief line, and contact terminals 42 for a heater within vessel 20.

Figure 2:
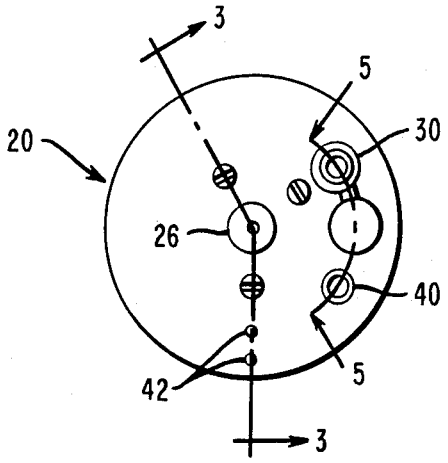
FIG. 2 is a top view of the pump shown in FIG. 1.

FIG. 2 shows a top view of vessel 20 with like numbers representing the same elements as described with respect to FIG. 1.

Figure 3:
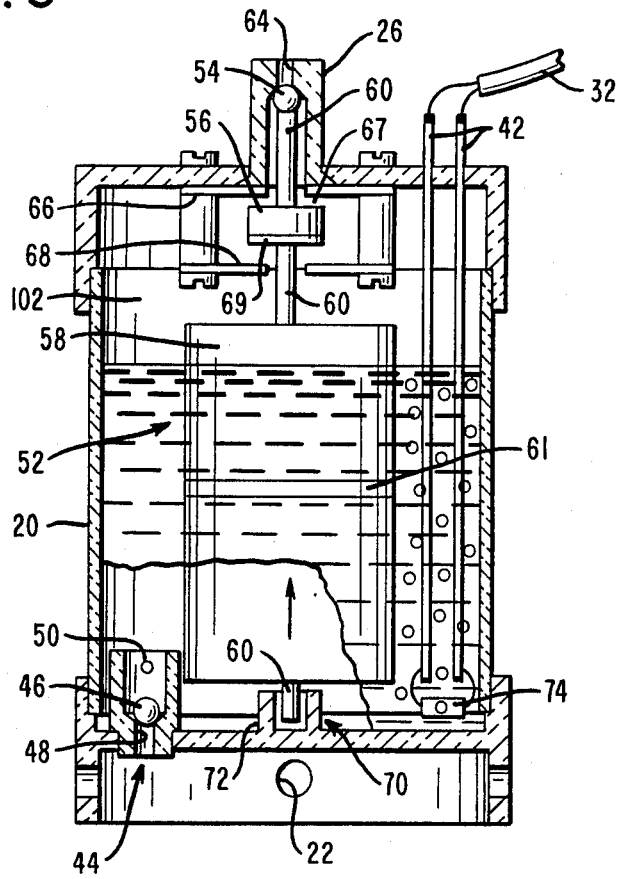
FIG. 3 is a cross sectional view of the pump taken along line 3—3 in FIG. 2 showing a high fluid level.

FIG. 3 shows a cross sectional view of vessel 20 taken along the line 3—3 in FIG. 2. An inlet valve 44 prevents fluid from flowing out of vessel 20 through fluid inlets 22. Valve 44 is a ball check valve having a ball 46 which covers orifice 48 when no fluid is entering vessel 20 but which is dislodged when fluid is entering vessel 20. In the latter condition a cage 50 prevents ball 46 from escaping.

A gas discharge valve 52 responds to the level of fluid within vessel 20 for opening and closing gas discharge outlet 26. Gas discharge valve 52 includes a dynamic valve member 54, a magnet 56, a float 58 with attached weight 61, a movable shaft 60, and guide means 70. Dynamic valve member 54, magnet 56 and float 58 are vertically aligned and fixed to vertically movable shaft 60. Guide means 70 includes a boss 72 for receiving the lower end of shaft 60 to prevent lateral movement of valve 52.

Figure 4:
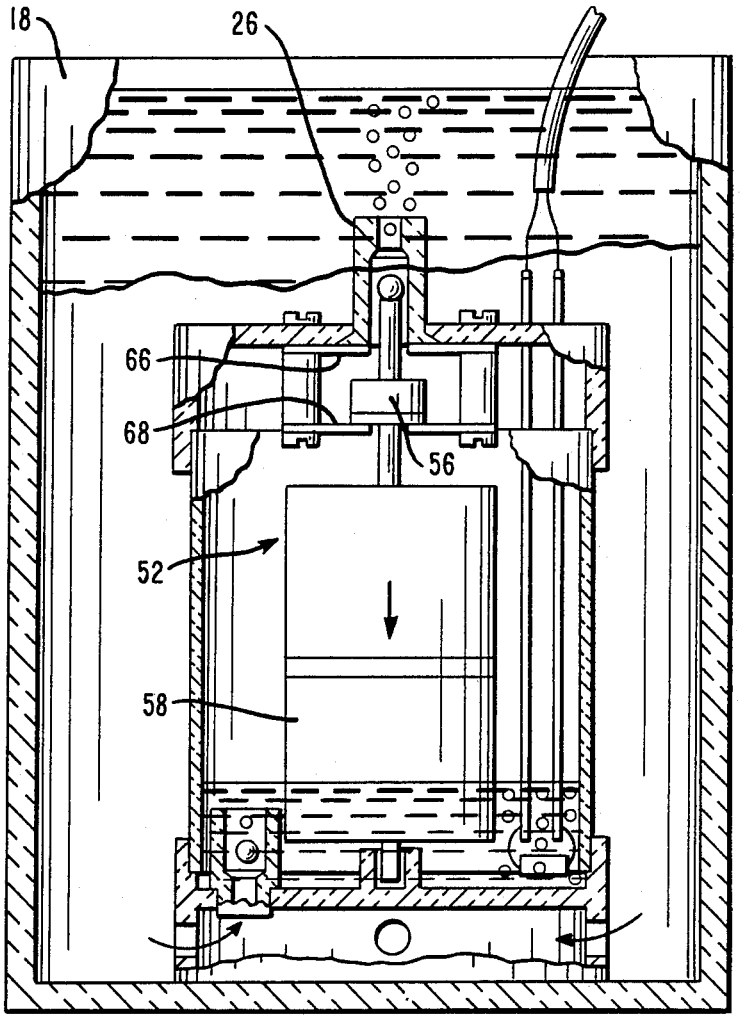
FIG. 4 is a another view of the pump in FIG. 3 showing the pump with a low fluid level and submerged in a reservoir.

Dynamic valve member 54 is a ball 62 which closes gas discharge outlet 26 by covering orifice 64 in outlet 26. FIG. 3 shows gas discharge outlet 26 closed (FIG. 4 shows it open). Magnet 56 is positioned between an upper attraction plate 66 and a lower attraction plate 68. The spacing between plates 66 and 68 and their relationship to magnet 56 and valve member 54 is such that when gas discharge outlet 26 is closed, magnet 56 will be proximate to but spaced apart from upper attraction plate 66 by an air gap 67. Air gap 67 is provided in order to ensure a complete seal of gas discharge outlet 26 and to better regulate the closure force. Similarly, a spacer 69 of about the same thickness as air gap 67 is attached to the bottom of magnet 56 so that magnet 56 is proximate to but not directly in contact with lower plate 68 when outlet 26 is open. Both the air gap 67 and spacer 69 are effective to balance the magnetic force with the float force. Float 58 provides an increasing upward force on shaft 60, as a result of increased buoyancy, in response to a rising fluid level within vessel 20. At some fluid level this upward force overcomes the attractive force between magnet 56 and lower attraction plate 68 and combines with the attractive force between magnet 56 and upper attraction plate 66 to move gas discharge valve 52 to the closed position of FIG. 3. Similarly, float 58 with weight 61 provides an increasing downward force on shaft 60, as its combined weight exceeds its buoyancy in response to a falling fluid level within vessel 20. At some fluid level this downward force overcomes the attractive force between magnet 56 and upper attraction plate 66 and combines with the attractive force between magnet 56 and lower attraction plate 68 to move gas discharge valve 52 to its open position (shown in FIG. 4).

FIG. 3 also shows an electric resistance heater 74 within vessel 20 connected to contact terminals 42 and positioned in the lower region of vessel 20. Referring back to FIG. 1, a wire 32 having conductors for supplying electric current to heater 74 is also connected to contact terminals 42. The conductors extend from a current source 34 outside reservoir 18 to contact terminals 42.

Figure 5:
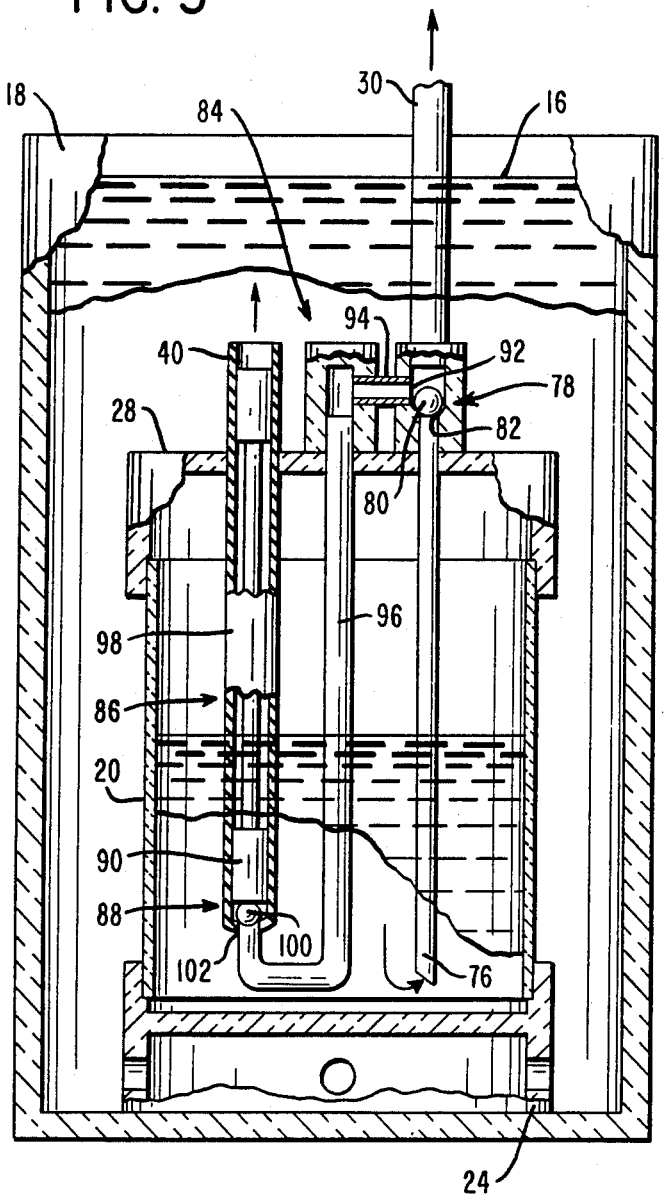
FIG. 5 is a cross sectional view of the pump, taken along the line 5—5 in FIG. 2, showing the pump submerged in a reservoir.

FIG. 5 shows another view of vessel 20, taken along the line 5—5 in FIG. 2. Conduit 30 which conducts fluid from inside vessel 20 to its destination has an inlet end 76 for receiving the fluid. Inlet end 76 is located within vessel 20 and proximate to the bottom 24 of vessel 20. Conduit 30 exits vessel 20 through top 28. An outlet valve 78 is provided to prevent fluid from flowing back into vessel 20 from conduit 30. Valve 78 is a ball check valve having a ball 80 which covers orifice 82 when no fluid is exiting vessel 20 thereby preventing backflow but which is dislodged when fluid is exiting vessel 20 to permit flow therethrough.

A pressure regulator 84 limits the pressure within conduit 30. Pressure regulator 84 comprises a pressure relief line 86, a pressure relief valve 88 in line 86 and biasing means in the form of a weight 90 for providing a predetermined closure force on valve 88. Line 86 taps into conduit 30 at opening 92 on the destination side of outlet valve 78 and includes an elbow or short cross member 94. Pressure relief line 86 is generally U-shaped with two vertically positioned legs 96 and 98. Leg 96 receives fluid from conduit 30 through cross member 94. Leg 98 discharges excessively pressurized fluid through valve 88 into reservoir 18. Pressure relief valve 88 is a ball check valve having a ball 100 which covers orifice 102 when no fluid is exiting line 86 but which is dislodged when fluid is exiting line 86. Valve 88 and weight 90 are disposed in leg 98 with weight 90 on top of ball 100.

In operation, current source 34 provides a current flow in wire 32 (FIG. 1) to heater 74. Heater 74 then causes fluid in vessel 20 to evaporate, thereby producing gas (FIG. 3). As long as the level of fluid in vessel 20 is relatively high, gas discharge valve 52 will remain closed and the gas of evaporation will create a pressure head in the upper region 102. This will produce a fluid flow through conduit 30 as the pressure head forces down the fluid level (FIG. 5). As long as container 12 requires cooling fluid, liquid level controller 36 will allow the fluid to enter container 12 (FIG. 1). When the level of fluid within container 12 rises to a predetermined level, controller 36 will cut off the flow into container 12 and the cooling fluid will be diverted as will be explained more fully hereafter. As heater 74 is operating the fluid level in vessel 20 will gradually drop and fluid will be discharged through conduit 30. However, when the fluid level drops below a predetermined point the weight of float 58 will overcome the attraction between magnet 56 and upper attraction plate 66 and gas discharge valve 52 will open (FIG. 4). The pressure head will dissipate as gas escapes through gas discharge outlet 26. Fluid will enter vessel 20 through fluid inlet 22 and inlet valve 44, but outlet valve 78 will close thereby preventing fluid from siphoning back through conduit 30. When the level of fluid rises significantly the buoyant force of float 58 will overcome the attraction between magnet 56 and lower attraction plate 68 and gas discharge valve 52 will again close (FIG. 3). Pumping of fluid through conduit 30 can then continue. Whenever controller 36 shuts off the flow into container 12, cooling fluid will be diverted through pressure regulator 84 and back into reservoir 18. Whenever the current to heater 74 is shut off the pumping action will cease.

Although fluid will be pumped through conduit 30 as long as gas discharge valve 52 is closed and heater 74 is evaporating fluid, the pressure within conduit 30 is limited by pressure regulator 84. The maximum allowable pressure is determined by weight 90. As soon as the pressure force within conduit 30 exceeds such weight fluid will be diverted from conduit 30 through pressure relief valve 88 into reservoir 18.

It will be clear to those skilled in the art that the present invention is not limited to the specific embodiment disclosed and illustrated herein. Furthermore, the invention will operate in a reservoir of fluid having a wide range of pressures. The invention is also not limited to delivery of cooling fluid to any specific container but applies equally to the delivery of cooling fluid to any destination.

It will be understood that the dimensions and proportional and structural relationships shown in the drawings are illustrated by way of example only and these illustrations are not to be taken as the actual dimensions or proportional structural relationships used in the pump of the present invention.

Numerous modifications, variations, and full and partial equivalents can be undertaken without departing from the invention as limited only be the spirit and scope of the appended claims.

What is desired to be secured by Letters Patent of the United states is as follows.

What is claimed is:

1. A pump for delivering a cooling fluid from a reservoir of said fluid to a destination comprising:

a vessel for holding fluid to be delivered, said vessel being submersible within said reservoir and having a fluid inlet near its bottom for receiving fluid from said reservoir and a gas discharge outlet near its top;

an inlet valve for preventing said fluid from flowing out of said vessel through said fluid inlet;

a gas discharge valve responsive to the level of fluid within said vessel for opening and closing said gas discharge outlet;

a conduit for conducting fluid from inside said vessel to said destination;

a pressure regulator for limiting the pressure within said conduit; and heating means for evaporating the fluid within said vessel to create a pressure head within said vessel when said gas discharge outlet is closed thereby causing said fluid to flow through said conduit.

2. The pump of claim 1 further comprising:

an outlet valve for preventing fluid from flowing into said vessel through said conduit.

3. The pump of claim 1 wherein said heating means includes an electric resistance heater and said pump further comprises:

means for supplying electric current to said heater, said means extending from outside said reservoir, through said vessel to said heater.

4. The pump of claim 1 wherein said conduit has an inlet end for receiving said fluid and wherein said inlet end is located within said vessel and proximate to said vessel bottom.

5. The pump of claim 5 wherein said conduit exits said vessel through said vessel top.

6. The pump of claim 1 wherein said pressure regulator comprises a pressure relief line tapped into said conduit, a pressure relief valve in said line and biasing means for providing a predetermined closure force on said valve.

7. The pump of claim 6 wherein said pressure relief line taps into said conduit on the destination side of said outlet valve and wherein said pressure relief line is generally U-shaped with two vertically positioned legs, a first leg for receiving fluid from said conduit and a second leg for discharging excessively pressurized fluid into said reservoir.

8. The pump of claim 7 wherein said pressure relief valve is a ball check valve disposed in said second leg of said pressure relief line, and wherein said biasing means includes a weight disposed in said second leg on top of said ball check valve.

9. A pump for delivering a cooling fluid from a reservoir of said fluid to a destination comprising:

a vessel for holding fluid to be delivered, said vessel being submersible within said reservoir and having a fluid inlet near its bottom for receiving fluid from said reservoir and a gas discharge outlet near its top;

an inlet valve for preventing said fluid from flowing out of said vessel through said fluid inlet;

a gas discharge valve responsive to the level of fluid within said vessel for opening and closing said gas discharge outlet;

a conduit for conducting fluid from inside said vessel to said destination; and heating means for evaporating the fluid within said vessel to create a pressure head within said vessel when said gas discharge outlet is closed thereby causing said fluid to flow through said conduit;

wherein said gas discharge valve comprises a dynamic valve member, magnet and float vertically aligned on a movable shaft, said dynamic valve member being adapted to open or close said gas discharge outlet, said magnet being positioned between upper and lower attraction plates, and said float providing an increasing downward force in response to a falling fluid level within said vessel and an increasing upward force in response to a rising fluid level within said vessel.

10. The pump of claim 9 wherein the spacing between said plates and their relationship to said magnet and said dynamic valve member is such that said valve member closes said gas discharge outlet when said magnet is attracted proximate to said upper attraction plate and said valve member opens said gas discharge outlet when said magnet is attracted proximate to said lower attraction plate.

11. The pump of claim 10 wherein said gas discharge valve further comprises guide means to prevent lateral movement of said valve.

12. A pump for delivering a cooling fluid from a reservoir of said fluid to a destination comprising:

a vessel for holding fluid to be delivered, said vessel being submersible within said reservoir and having a fluid inlet near its bottom for receiving fluid from said reservoir and a gas discharge outlet near its top;

an inlet valve for preventing said fluid from flowing out of said vessel through said fluid inlet;

a gas discharge valve responsive to the level of fluid within said vessel for opening and closing said gas discharge outlet, wherein said gas discharge valve comprises a dynamic valve member, magnet and float vertically aligned on a movable shaft, said dynamic valve member being adapted to open or close said gas discharge outlet, said magnet being positioned between upper and lower attraction plates, and said float providing an increasing downward force in response to a falling fluid level within said vessel and an increasing upward force in response to a rising fluid level within said vessel, and wherein the spacing between said plates and their relationship to said magnet and said dynamic valve member is such that said valve member closes said gas discharge outlet when said magnet is attracted proximate to said upper attraction plate and said valve member opens said gas discharge outlet when said magnet is attracted proximate to said lower attraction plate;

a conduit for conducting fluid from inside said vessel to said destination, said conduit having an inlet end for receiving said fluid, wherein said inlet end is located within said vessel and proximate to said vessel bottom;

an electric resistance heater for evaporating the fluid within said vessel to create a pressure head within said vessel when said gas discharge outlet is closed thereby causing said fluid to flow through said conduit;

means for supplying electric current to said heater, said means extending from outside said reservoir, through said vessel to said heater;

an outlet valve for preventing fluid from flowing into said vessel through said conduit; and a pressure regulator for limiting the pressure within said conduit, said pressure regulator comprising a pressure relief line tapped into said conduit, a pressure relief valve in said line and biasing means for providing a predetermined closure force on said valve, wherein said pressure relief line taps into said conduit on the destination side of said outlet valve and wherein said pressure relief line is generally U-shaped with two vertically positioned legs, a first leg for receiving fluid from said conduit and a second leg for discharging excessively pressurized fluid into said reservoir.

13. The pump of claim 12 wherein said pressure relief valve is a ball check valve disposed in said second leg of said pressure relief line, and wherein said biasing means includes a weight disposed in said second leg on top of said ball check valve.

14. The pump of claim 13 wherein said gas discharge valve further comprises guide means to prevent lateral movement of said valve.

15. The pump of claim 14 wherein said conduit exits said vessel through said vessel top.

16. A method for delivering a cooling fluid from a reservoir of said fluid to a container comprising:

immersing a pump in said reservoir;

admitting fluid from said reservoir into said pump;

evaporating cooling fluid within said pump to create a gas pressure head in said pump;

delivering fluid from said pump to said container in response to said pressure head;

sensing the fluid level within said container; and diverting said delivered cooling fluid from said container back into said reservoir in response to said sensed fluid level within said container.

17. A method for delivering a cooling fluid from a reservoir of said fluid to a container comprising:

immersing a pump in said reservoir;

admitting fluid from said reservoir into said pump;

evaporating cooling fluid within said pump to create a gas pressure head in said pump;

delivering fluid from said pump to said container in response to said pressure head;

sensing the fluid level within said pump; and relieving said gas pressure head in said pump in response to said sensed fluid level.

* * * * *

UNITED STATES PATENT AND TRADEMARK OFFICE

CERTIFICATE OF CORRECTION

PATENT NO. : 4,852,357

DATED : August 1, 1989

INVENTOR(S) : Warren W. Porter

It is certified that error appears in the above-identified patent and that said Letters Patent is hereby corrected as shown below:

Column 5, line 22, delete "5" and substitute --4--.

Signed and Sealed this

Fifteenth Day of May, 1990

*Attest:*

HARRY F. MANBECK, JR.

*Attesting Officer*

*Commissioner of Patents and Trademarks*